US006649039B2

(12) United States Patent
Hsu et al.

(10) Patent No.: US 6,649,039 B2
(45) Date of Patent: Nov. 18, 2003

(54) PROCESS OF SURFACE TREATING ALUMINUM ARTICLES

(75) Inventors: Che-Yuan Hsu, Tu-Chen (TW); Fu-Keng Yang, Tu-Chen (TW); Wen-Shan Chien, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 2 days.

(21) Appl. No.: 10/036,830

(22) Filed: Dec. 29, 2001

(65) Prior Publication Data

US 2003/0075452 A1 Apr. 24, 2003

(30) Foreign Application Priority Data

Oct. 24, 2001 (TW) ..... 90126335 A

(51) Int. Cl.[7] ..... C25D 11/18; C25D 5/48

(52) U.S. Cl. ..... 205/202; 205/201; 205/203; 205/220

(58) Field of Search ..... 205/201, 202, 205/203, 220

(56) References Cited

U.S. PATENT DOCUMENTS 4,239,610 A * 12/1980 Severus-Laubenfeld ..... 204/211
5,167,793 A * 12/1992 Jozefowicz ..... 205/121

* cited by examiner

*Primary Examiner*—Edna Wong
(74) *Attorney, Agent, or Firm*—Wei Te Chung

(57) ABSTRACT

A process of surface treating an aluminum or aluminum alloy article includes the steps of: (1) forming an oxide layer on the aluminum or aluminum alloy article by anodizing; (2) sealing the oxide layer of the article; and (3) forming a protective film on the sealed oxide layer of the article. The process may further comprise a step of coloring the oxide layer of the aluminum or aluminum alloy article between the steps (1) and (2). The aluminum or aluminum alloy article is corrosion-resistant and resistant to damage by contact, by virtue of the protective film formed on the scaled oxide layer in the step (3). In addition, the protective film can also give the aluminum or aluminum alloy article a long-lasting attractive appearance by preventing a colored sealed oxide layer of the aluminum or aluminum alloy article from fading.

17 Claims, 1 Drawing Sheet

PROCESS OF SURFACE TREATING ALUMINUM ARTICLES

BACKGROUND OF THE INVENTION

1. Field of the Invention

The present invention relates to a process of surface treating aluminum or aluminum alloy articles, and particularly to a process of surface treating aluminum or aluminum alloy articles which have been anodized.

2. Description of the Related Art

Articles made of aluminum or aluminum alloy are often anodized to form an oxide layer and subsequently colored to obtain decorative appearances.

Conventional processes for coloring surfaces of aluminum or aluminum alloy articles comprise color anodizing, adsorptive coloring and electrolytic coloring.

In color anodizing (integral method), aluminum or aluminum alloy articles are colored by finely divided inorganic dye particles which remain as an alloying constituent in oxide layers of the articles.

In adsorptive coloring, an organic dye is introduced into pores of an oxide layer of an aluminum or aluminum alloy article. The organic dye remains absorbed in a surface region of the oxide layer of the article.

Electrolytic coloring uses metal salt solutions to produce a colored oxide layer on the aluminum or aluminum alloy article. In a first process step of anodic oxidation, direct current is applied to aqueous sulfuric acid or other electrolyte solutions. In a second process step, the article is colored by applying alternating current to metal salt solutions. Metal particles are deposited at a bottom of pores in an oxide layer of the aluminum or aluminum alloy article.

Oxide layers on the aluminum or aluminum alloy articles are unstable and porous. The layers are liable to be degenerated by contact or by corrosive substances. In addition, such layers frequently also have an unattractive appearance. Furthermore, in adsorptive and electrolytic coloring, the obtained color easily fades due to lack of a protective layer on the colored surface.

In order to overcome the foregoing drawbacks, U.S. Pat. No. 4,648,911 discloses a process for sealing the surface of an anodized aluminum or aluminum alloy. The sealing process reduces the dimensions of the pores of the oxide layers on the surface of the aluminum or aluminum alloy, and thereby inhibits the aluminum or aluminum alloy from corroding or fading.

However, inhibition of corrosion or fading merely reduces the rate at which the oxide layer degenerates. The disclosed process does not completely or even thoroughly solve the aforementioned problems. Hence it is desired to provide a process of surface treating aluminum or aluminum alloy articles which can overcome the foregoing drawbacks of conventional processes.

SUMMARY OF THE INVENTION

A main object of the present invention is to provide a process of surface treating an aluminum or aluminum alloy article which prevents the article from being corroded.

Another object of the invention is to provide a process of surface treating an aluminum or aluminum alloy article which gives the article a long-lasting attractive appearance.

To achieve the above objects, a process of surface treating an aluminum or aluminum alloy article according to the present invention comprises the steps of: (1) forming an oxide layer on the aluminum or aluminum alloy article by anodizing; (2) sealing the oxide layer of the article; and (3) forming a protective film on the sealed oxide layer of the article.

The process may further comprise a step of coloring the oxide layer of the aluminum or aluminum alloy article between said steps (1) and (2).

The aluminum or aluminum alloy article is corrosion-resistant and resistant to damage by contact, by virtue of the protective film formed on the sealed oxide layer in said step (3). In addition, the protective film can also give the aluminum or aluminum alloy article a long-lasting attractive appearance by preventing a colored sealed oxide layer of the aluminum or aluminum alloy article from fading.

For the purpose of making the invention easier to understand, three embodiments thereof are described in detail herein, in which:

DETAILED DESCRIPTION OF THE INVENTION

Figure 1:
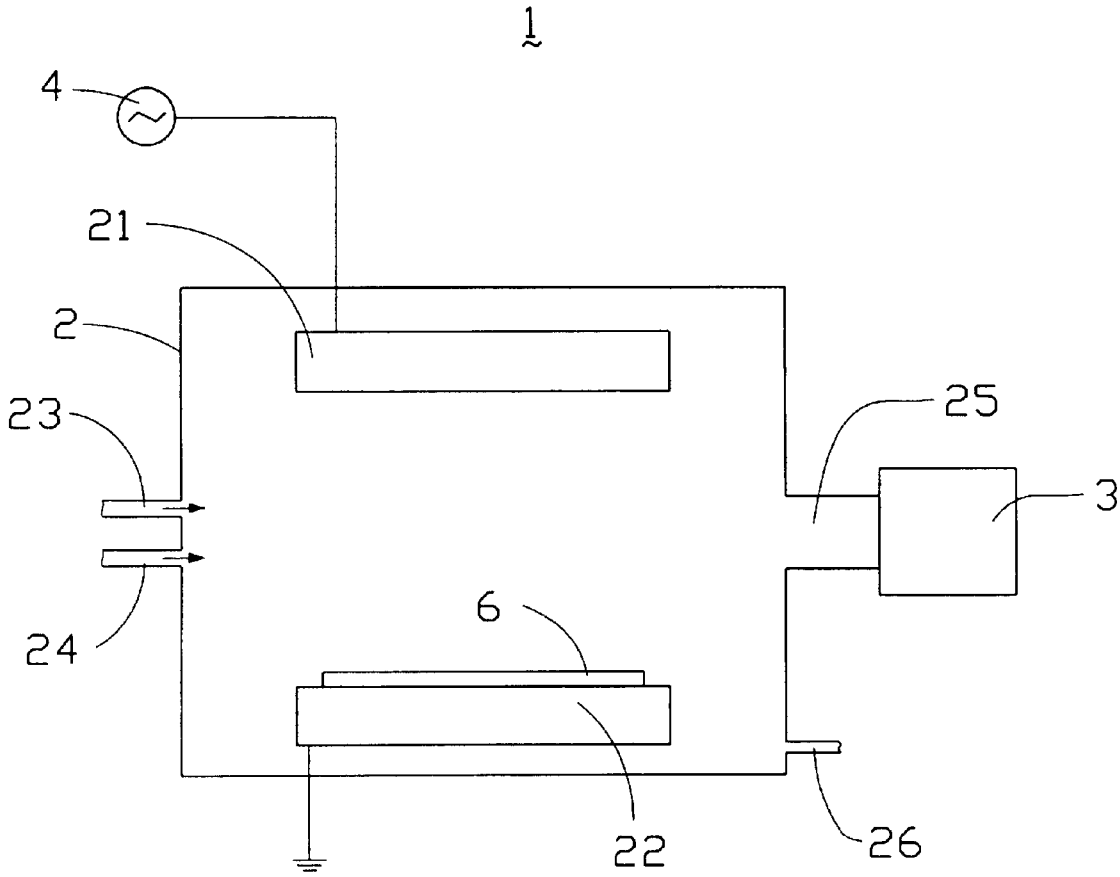
FIG. 1 is a schematic view of a coating device of the present invention.

A process of surface treating an aluminum or aluminum alloy article according to the present invention comprises the steps of: (1) forming an oxide layer on the aluminum or aluminum alloy article by anodizing; (2) sealing the oxide layer of the aluminum or aluminum alloy article; and (3) forming a protective film on the sealed oxide layer of the aluminum or aluminum alloy article.

The process may further comprise a step of coloring the oxide layer of the aluminum or aluminum alloy article between said steps (1) and (2).

The following embodiments are intended to illustrate the invention. The invention is, however, by no means limited to the particulars disclosed in the embodiments.

Embodiment 1

A process of surface treating an aluminum or aluminum alloy article in accordance with the present invention comprises the following steps:

(1) Forming an oxide layer on an aluminum or aluminum alloy article by anodizing. This step includes, before anodizing, the aluminum or aluminum alloy article being degreased, cleaned with water, electrolytically or chemically polished, and cleaned with water a second time. Then the article is directly immersed into an electrolytic bath for anodizing. The electrolytic bath contains an aqueous electrolyte, such as sulfuric acid. Direct current is applied to the electrolytic bath. The anodizing process is carried out under the following conditions. The sulfuric acid has a concentration of 150–2000 g/l, and is maintained at a temperature of 18–23° C. The direct current applied is 12–20 volts, and has a current density of 1–2 A/dm$^2$. The process is continued for a period ranging from 15 minutes to one hour until an oxide layer formed on the article reaches a thickness of about 3–30 $\mu$m.

(2) Coloring the oxide layer of the aluminum or aluminum alloy article formed by anodizing. The article is immersed into a coloring bath. In the coloring process, the coloring bath contains an electrolyte, and alternating current is applied. The electrolyte contains tin (Sn)

(II) ions, cobalt (Co) ions, nickel (Ni) ions or copper (Cu) ions. The alternating current applied is 5–30 volts. The coloring process is continued for a period ranging from 1–15 minutes.

(3) Sealing the colored oxide layer of the aluminum or aluminum alloy article. The sealing treatment is quite well known by those skilled in the art. Therefore a detailed description thereof is omitted herefrom.

(4) Coating the sealed colored oxide layer of the aluminum or aluminum alloy article. This step comprises preheating the colored aluminum or aluminum alloy article to 100–200° C., and then coating the preheated article in a coating device to form a protective film on the sealed colored oxide layer of the article.

Referring to FIG. 1, the coating device 1 comprises a chamber 2, a pumping system 3 and a radio frequency (RF) power supply 4. The chamber 2 comprises a first electrode 21, a second electrode 22, two gas inlets 23, 24 to introduce reaction gases into the chamber 2, a pumping port 25, and an exhaust outlet 26. The first electrode 21 connects with the RF power supply 4, and with the second electrode 22 which is grounded. The first electrode 21 is positioned parallel to a direction of gas flow from the gas inlet 23, 24 to serve as a distributor of the reaction gases. The second electrode 22 serves as a table to support the preheated aluminum or aluminum alloy article 6. The pumping port 25 is connected with the pumping system 3 to reduce a pressure of an interior of the chamber 2. The exhaust outlet 26 is connected to a gas withdrawal device (not shown), so that reacted gases and unreacted gases can be expelled from the chamber 2 to keep the pressure of the interior of the chamber 2 at a predetermined level.

An aluminum or aluminum alloy article 6 is placed on the second electrode 22 in the chamber 2. The pressure of the interior of the chamber 2 is reduced to a predetermined level by the pumping system 3. RF power is applied to the electrode 21 by the RF power supply 4, and the reaction gases are introduced into the chamber 2 from the gas inlets 23, 24. The gases located between the first and second electrodes 21, 22 are converted to plasma. The plasma reacts on the surface of the article 6 to form a film.

During the forgoing process, the pressure in the chamber 2 is maintained within the range of 20 millitorr–to 10 torr. The RF power is 400–600 watts (W), and has a frequency of 12–15 megahertz (MHz). The reaction gases comprise a first gas having an organic compound with silicon-hydrogen (Si—H) bonds, and an oxidizing gas as a second gas. The flow rates of the first gas and the oxidizing gas are respectively 50–150 standard cubic centimeters per minute (SCCM) and 200–300 SCCM. The organic compound is preferably 1,1,3,3-tetramethyldisiloxane or 1,1,1,3,3,3-hexamethyldisiloxane The oxidizing gas is preferably oxygen, and the film formed is a silicon oxide film.

Embodiment 2

A process of surface treating an aluminum or aluminum alloy article in accordance with the present invention comprises the following steps:

(1) Forming a colored oxide layer on the aluminum or aluminum alloy article. This step includes, before anodizing, the article being mechanically polished, chemically degreased, cleaned with water, chemically processed, and cleaned with water a second time. Then the article is immersed into an electrolytic bath for anodizing. The electrolytic bath contains an electrolyte; for example, a mixture of sulfuric acid and sulfosalicylic acid. Direct current is applied to the electrolytic bath. The anodizing process is carried out under the following conditions. Concentrations of the sulfuric acid and sulfosalicylic acid are respectively 0.1–1% by weight and 10–20% by weight and they are maintained at a temperature of 16–25° C. The direct current applied is 40–80 volts, and has a current density of 1–4 A/dm$^2$. The process is continued for a period ranging from 15 minutes to one hour until a colored oxide layer formed on the article reaches a thickness of about 3–30 $\mu$m.

(2) Sealing the oxide layer of the aluminum or aluminum alloy article.

(3) Coating the sealed oxide layer of the aluminum or aluminum alloy article by the coating process of Embodiment 1.

Embodiment 3

A process of surface treating an aluminum or aluminum alloy article in accordance with the present invention comprises the following steps:

(1) Forming an oxide layer on the aluminum or aluminum alloy article by anodizing. This step includes, before anodizing, the aluminum or aluminum alloy article being degreased, cleaned with water, electrolytically or chemically polished, and cleaned with water a second time. Then the article is directly immersed into an electrolytic bath for anodizing. The electrolytic bath contains an aqueous electrolyte, for example sulfuric acid. Direct current is applied to the electrolytic bath. The anodizing process is carried out under the following conditions. The sulfuric acid has a concentration of 150–2000 g/l, and is maintained at a temperature of 18–23° C. The direct current applied is 12–20 volts, and has a current density of 1–2 A/dm$^2$. The process is continued for a period ranging from 15 minutes to one hour, until an oxide layer formed on the article reaches a thickness of about 3–30 $\mu$m.

(2) Coloring the oxide layer of the aluminum or aluminum alloy article. The article is immersed into a color bath which contains an organic dye, until the oxide layer of the article is dyed to a desired color.

(3) Sealing the colored oxide layer of the aluminum or aluminum alloy article.

(4) Coating the sealed colored oxide layer of the aluminum or aluminum alloy article by the coating process of Embodiment 1.

Although the present invention has been described in terms of three particular embodiments, it is quite obvious that the present invention is in no way limited to the embodiments, and that various alternatives and modifications can be made to the embodiments without in any way departing from either the scope or spirit of the present invention.

We claim:

1. A process of surface treating an aluminum or aluminum alloy article comprising:

(1) forming an oxide layer on the aluminum or aluminum alloy article by anodizing;

(2) sealing the oxide layer of the article; and (3) forming a protective film on the sealed oxide layer of the article, wherein the protective film is formed by a coating device which comprises a chamber, a pumping system and a radio frequency power supply.

2. The process according to claim 1, further comprising a step of performing coloring treatment of the oxide layer of the article between said steps (1) and (2).

3. The process according to claim 1, wherein the chamber of the coating device comprises a pair of electrodes to apply a voltage from the power supply, two gas inlets to introduce reaction gases into the chamber, a pumping port to reduce a pressure of an interior of the chamber, and an exhaust port.

4. The process according to claim 3, wherein one of the pair of electrodes is connected with the power supply, and the other of the pair of electrodes is grounded and serves as a support for the aluminum or aluminum alloy article.

5. The process according to claim 4, wherein during said step (3), the reaction gases are introduced from the gas inlets into the chamber, the reaction gases between the pair of electrodes are converted to plasma, and the plasma reacts on the oxide layer of the article to form the film.

6. The process according to claim 5, wherein during said step (3), a pressure in the chamber is maintained within the range of 20 millitorr to 10 torr, the radio frequency power is within the range of 400 to 600 watts, and the radio frequency is within the range of 12 to 15 megahertz.

7. The process according to claim 6, wherein the reaction gases comprise a first gas having an organic compound with silicon-hydrogen bonds, and an oxidizing gas as a second gas, flow rates of the first gas and the oxidizing gas being respectively maintained within the range of 50 to 150 standard cubic centimeters per minute and within the range of 200 to 300 standard cubic centimeters per minute.

8. The process according to claim 7, wherein the organic compound is 1,1,3,3-tetramethyldisiloxane or 1,1,1,3,3,3-hexamethyldisiloxane, and the oxidizing gas is oxygen.

9. The process according to claim 7, wherein the film formed on the oxide layer is a silicon oxide film.

10. A process of surface treating an aluminum or aluminum alloy article comprising:

(1) forming an oxide layer on the aluminum or aluminum alloy article by anodizing the article;

(2) coloring the oxide layer of the article;

(3) sealing the colored oxide layer of the article; and (4) forming a protective film on the sealed colored oxide layer of the article, wherein the protective film is formed by a reaction of reactive gases and then deposition on the sealed colored oxide layer of the article in a chamber.

11. The process according to claim 10, wherein a method of coloring the oxide layer of the article at step (2) is adsorptive coloring.

12. The process according to claim 10, wherein a method of coloring the oxide layer of the article at step (2) is electrolytic coloring.

13. The process according to claim 10, wherein the chamber comprises a pair of electrodes to apply a radio frequency power from a radio frequency power supply, two gas inlets to introduce the reaction gases into the chamber, a pumping port to reduce a pressure of an interior of the chamber, and an exhaust port.

14. A process of surface treating an aluminum or aluminum alloy article comprising:

(1) forming an oxide layer on the aluminum or aluminum alloy article by anodizing the article; and (2) forming a protective film on the oxide layer of the article, wherein the protective film is formed by introducing reactive gases into a chamber and converting the reactive gases to plasma, thus reacting to deposit the protective film on the oxide layer of the article.

15. The process according to claim 14, further comprising a step of coloring the oxide layer of the article between said steps (1) and (2).

16. The process according to claim 14, further comprising a step of sealing the oxide layer of the article between said steps (1) and (2).

17. The process according to claim 14, the chamber comprises a pair of electrodes to apply a radio frequency power from a radio frequency power supply, two gas inlets to introduce the reaction gases into the chamber, a pumping port to reduce a pressure of an interior of the chamber, and an exhaust port.

* * * * *